US008135150B2

(12) United States Patent
Izuchi et al.

(10) Patent No.: US 8,135,150 B2
(45) Date of Patent: Mar. 13, 2012

(54) ELECTRET CONDENSOR MICROPHONE

(75) Inventors: Toshiro Izuchi, Fukuoka (JP); Kensuke Nakanishi, Fukuoka (JP); Tsuyoshi Baba, Fukuoka (JP)

(73) Assignee: Hosiden Corporation, Osaka (JP)

( * ) Notice: Subject to any disclaimer, the term of this patent is extended or adjusted under 35 U.S.C. 154(b) by 1209 days.

(21) Appl. No.: 11/903,189

(22) Filed: Sep. 20, 2007

(65) Prior Publication Data

US 2008/0080729 A1 Apr. 3, 2008

(30) Foreign Application Priority Data

Sep. 29, 2006 (JP) ..... 2006-268192

(51) Int. Cl.
*H04R 25/00* (2006.01)

(52) U.S. Cl. ..... 381/191; 381/174

(58) Field of Classification Search ..... 381/191, 381/174, 175, 113, 116; 367/170, 181
See application file for complete search history.

(56) References Cited

U.S. PATENT DOCUMENTS

| | | | | |
|---|---|---|---|---|
| 3,812,575 | A * | 5/1974 | Hedman | 29/594 |
| 4,858,719 | A * | 8/1989 | Fidi et al. | 181/158 |
| 5,097,515 | A * | 3/1992 | Baba | 381/191 |
| 5,272,758 | A * | 12/1993 | Isogami et al. | 381/191 |
| 6,904,155 | B2 * | 6/2005 | Yonehara et al. | 381/174 |
| 6,999,596 | B2 * | 2/2006 | Hiramoto et al. | 381/191 |
| 2006/0177085 | A1 * | 8/2006 | Izuchi et al. | 381/369 |

FOREIGN PATENT DOCUMENTS

| | | |
|---|---|---|
| EP | 0371620 | 6/1990 |
| EP | 0531613 | 4/1992 |
| EP | 1494503 | 5/2005 |
| EP | 1691570 | 1/2006 |
| JP | 2548543 | 5/1997 |

* cited by examiner

*Primary Examiner* — Ha Tran T Nguyen
*Assistant Examiner* — Jordan Klein
(74) *Attorney, Agent, or Firm* — The Webb Law Firm

(57) ABSTRACT

An electret condenser microphone comprising a metal capsule having a top surface provided with sound receiving holes, a diaphragm, a back electrode plate that faces either one of surfaces of the diaphragm and that is provided separately from the capsule, and an electret layer formed on the back electrode plate or the diaphragm. The diaphragm, the back electrode plate and the electret layer are all mounted inside the capsule. The top surface includes a suctioned portion in its center on which suction force can be applied by a suction-type transporting device, and the sound holes are formed circumferentially around the suctioned portion.

5 Claims, 3 Drawing Sheets

ELECTRET CONDENSOR MICROPHONE

REFERENCE TO THE RELATED APPLICATION

The present application claims priority from JP 2006-268192 filed by the same applicant on Sep. 29, 2006 in Japan, the entire disclosure of which is hereby incorporated herein by reference.

BACKGROUND OF THE INVENTION

1. Field of the Invention

The present invention relates to an electret condenser microphone (referred to as an "ECM" hereinafter) comprising a metal capsule having a top surface provided with sound receiving holes, a diaphragm, a back electrode plate that faces either one of surfaces of the diaphragm and that is provided separately from the capsule, and an electret layer formed on the back electrode plate or the diaphragm. The diaphragm, the back electrode plate and the electret layer are all mounted inside the capsule.

2. Description of the Related Art

The ECM is applied to a wide variety of electronic devices including mobile phones, PDAs, digital cameras, etc. Since the ECM is a very small component, the reflow mounting technique, for example, is often used in mounting the ECM on the various devices, in which solder is applied on a circuit board to provide the ECM, and then the circuit board is heated to be fixed with solder. In the process of reflow mounting, the ECM is sometimes transported onto the circuit board by using a suction-type transporting device in order to expedite the process for mounting the ECM on the circuit board.

As shown in FIG. 6, many of the conventional ECMs include a sound hole formed in the center of a top surface of a capsule comprising a box-shaped member. Thus, when using the suctioned-type transporting device, suction force is applied on any portion other than the sound hole to transport the ECM to a desired position on the circuit board so as not to damage the diaphragm or the like mounted inside the ECM. (see Japanese U.M. Registration No. 2,548,543, FIG. 1)

SUMMARY OF THE INVENTION

When the conventional ECM is transported, it is sometimes difficult to maintain a predetermined posture since suction force is applied on a portion other than the sound hole that is displaced from the center of gravity. Where the transporting device contacts a portion in the vicinity of the edge of the top surface, for example, the ECM is likely to incline to fall. On the other hand, if a greater suction force of the transporting device is applied in order to solve the above-noted problems, the top surface of the capsule is disadvantageously deformed or the like, which leaves room for improvement.

The present invention has been made having regard to the above-noted drawbacks, and its object is to provide the ECM suitable for being transported by suction in executing the reflow mounting process.

In order to achieve the above-noted object, a first aspect in accordance with the present invention provides an ECM comprising a metal capsule having a top surface provided with sound receiving holes, a diaphragm, a back electrode plate that faces either one of surfaces of the diaphragm and that is provided separately from the capsule, and an electret layer formed on the back electrode plate or the diaphragm, the diaphragm, the back electrode plate and the electret layer being all mounted inside the capsule, wherein the top surface includes a suctioned portion in its center on which suction force can be applied by a suction-type transporting device, and wherein the sound holes are formed circumferentially around the suctioned portion.

With this construction, the suctioned portion is provided in the center of the top surface of the capsule of the ECM, which allows a suction nozzle of the suction-type transporting device to agree with the center of the top surface that generally coincides with the center of gravity of the ECM in applying suction force. As a result, the posture of the ECM as transported is less subject to change, and the suction process may be reliably effected.

Also, moment applied on the suctioned portion in time of suction is reduced, which can minimize the suction force of the suction-type transporting device to prevent the top surface from being deformed.

In addition, since the sound holes are not formed in the suctioned portion provided in the top surface of the capsule, the ECM can be safely transported without damaging the diaphragm or the back electrode plate mounted inside the capsule in time of suction by the suction nozzle of the suction-type transporting device.

Further, since the diaphragm and the back electrode plate are provided separately from the capsule, there is no chance for the diaphragm or the back electrode plate constituting a primary component to be deformed while the capsule per se may be deformed. This can prevent deterioration of the performance of the ECM due to deformation of the capsule.

A second aspect of the ECM in accordance with the present invention lies in that the sound holes include arc shaped slits arranged circumstantially around the suctioned portion.

With this construction, since the sound holes each having an opening with a predetermined area can be arranged as close to the center of the capsule as possible, the sound collecting performance can be improved.

Further, the slit shape of the sound holes can diminish the opening width thereof as compared with circular or polygonal sound holes with the same opening width, reducing the chances that dust and waterdrops enter the capsule. As a result, the durability and reliability of the ECM can be enhanced.

A third aspect in accordance with the present invention lies in that the sound holes are formed outside a circle having the center that coincides with the center of the top surface and having the radius that is half the shortest radius measured from the center of the top surface to the outer edges thereof.

With this construction, since the suctioned portion is provided over a wider area of the center of the top surface than the conventional ECM, the suction nozzle of the suction-type transporting device can reliably contact the suctioned portion other than the sound holes, which allows the ECM to be transported more stably.

Further, since the suctioned portion has a sufficiently wider area than the area of the distal end of the suction nozzle, the shape of the suction nozzle can be determined at need to be suitable for transportation of the ECM.

A fourth aspect in accordance with the present invention lies in that the top surface has a rectangular shape and the sound holes each have the center positioned on a diagonal line of the top surface.

With this construction, the distance between the sound holes and the outer edges is increased as compared with the case where the slit shaped sound holes surrounding the suctioned portion are formed in other portions of the top surface. As a result, the sound holes are provided in the portion remote from the center of the capsule to secure as wide an area as possible for the suctioned portion, and yet the distance between the edges of the top surface and the sound holes can be maintained in a predetermined value or more to enhance the rigidity of the capsule.

A fifth aspect in accordance with the present invention lies in that the top surface includes a first top surface and a second top surface projecting from the first top surface, and that the suctioned portion is formed in the second top surface.

With this construction, a space is formed between part of the capsule including the top surface and the diaphragm mounted inside the capsule. Therefore, the spacer provided in the conventional ECM for allowing the diaphragm to be spaced from the top surface is dispensable, which can reduce the number of parts.

In addition, a further surface is provided in a boundary between the first top surface and the second top surface at a predetermined angle with respect to the first top surface and the second top surface, as a result of which high rigidity of the capsule can be maintained.

A sixth aspect in accordance with the present invention lies in that the sound holes are formed in a boundary between the first top surface and the second top surface.

With this construction, since the sound holes are formed at a predetermined angle with respect to the first top surface and the second top surface, it is more unlikely that dust and waterdrops enter the interior of the capsule than the arrangement including the sound holes in the top surface. As a result, the durability and the reliability of the ECM can be enhanced.

Further, even when the suction nozzle of the transporting device contacts a portion displaced from the suctioned portion, the sound holes open in a direction different to the top surface, and thus are not sealed tight by the suction nozzle, which can prevent the diaphragm and the back electrode plate mounted inside the capsule from being damaged.

PREFERRED EMBODIMENT

First Embodiment

Figure 1:
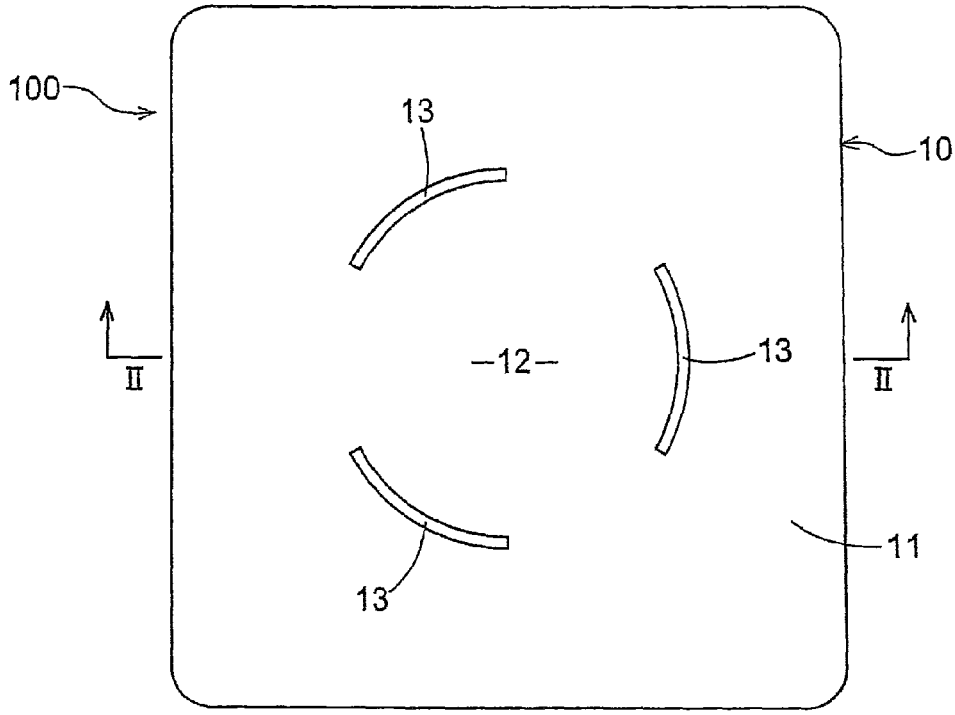
FIG. 1 is a top plan view of an ECM in accordance with the first embodiment of the present invention.
Figure 2:
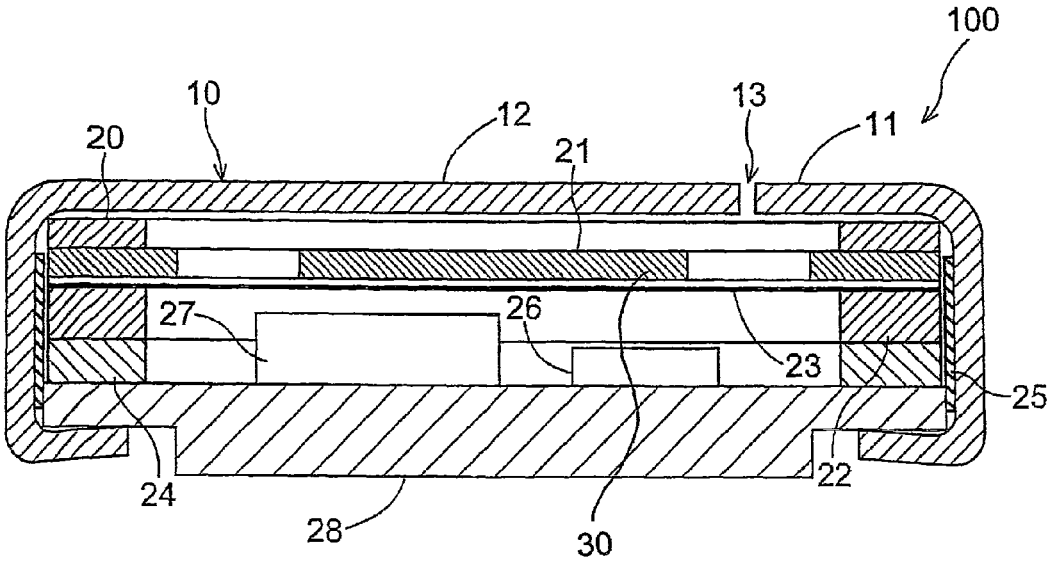
FIG. 2 is a sectional view of the ECM taken along the line II-II of FIG. 2.

The first embodiment of an ECM 100 in accordance with the present invention will be described hereinafter with reference to FIGS. 1 and 2 showing a type of an ECM 100 with a back electrode plate 21 and a diaphragm 23 whose vertical positions are reversed from those in a back electret type ECM. More particularly, the diaphragm 23 and the back electrode plate 21 are layered above a circuit board 28 in the mentioned order, which are enclosed by a capsule 10. An electret layer 30 is formed on the back electrode plate 21 or the diaphragm 23.

The structure of the ECM 100 will be described from the top surface 11 on down.

Under the top surface 11 is mounted a washer ring 20 for securing a space between the top surface 11 and the back electrode plate 21.

The back electrode plate 21 and the diaphragm 23 act as a pair to form a capacitor 26 for converting sound signals to electric current. A plurality of holes are formed in the back electrode plate 21 to facilitate transmission of sound to the diaphragm 23. It is preferable to use a back electrode plate 21 in which the electret is formed by thermally fusing a polymeric film such as polyester to a fixed electrode.

A foil 22 is provided under the back electrode plate 21. The diaphragm 23 is mounted on an end face of the foil 22 adjacent to the back electrode plate 21. This allows the back electrode plate 21 to be placed very close to the diaphragm 23. A typical example of the diaphragm 23 that is preferably used includes a high-polymer thin film made of polyester or the like and having a thickness between 2 μm and 4 μm and with a conductive layer formed by vapor-depositing nickel or aluminum evaporated on one surface thereof.

The back electrode plate 21 and the diaphragm 23 are provided separately from the capsule 10. This arrangement can eliminate the influences exerted on the back electrode plate 21 and the diaphragm 23 in case the capsule 10 is deformed.

A gate ring 24 is provided under the foil 22 for maintaining a constant distance between the circuit board 28 and the diaphragm 23.

On the circuit board 28 are mounted a chip capacitor 26 and an FET 27.

Further, the capsule 10 has lateral inner side faces coated with insulating material 25 to insulate the capsule 10 from the back electrode plate 21 or the diaphragm 23.

The capsule 10 is formed of a flat plate made of aluminum, for example, one surface of which is shaped into a bottomed rectangular (or polygonal) tube by press work. Sound holes 13 including arc shaped slits are formed in the top surface 11 by punching. After the back electrode plate 21, the diaphragm 23 and the circuit board 28 are inserted into the capsule 10 in the mentioned order, the rear end of the capsule 10 is deformed to fix the entire unit.

The top surface 11 of the bottomed rectangular (or polygonal) tubular capsule 10 includes a suctioned portion 12 having an area larger than a suction nozzle. This stabilizes a contact between an end face of the suction nozzle and the suctioned portion 12.

Further, when the ECM 100 is horizontally transported, the portion right above the center of gravity is held by applying suction on the center of the top surface 11. This helps reducing changes in the posture of the ECM 100 when transporting, thus making it less likely for the ECM 100 to fall. As a result, a suction force of a transporting device can be set to a small value to prevent deformation of the capsule 10 and allow a small transporting device to be used.

The sound holes 13 including the arc shaped slits are provided around the suctioned portion 12. Sounds from the outside are taken into the interior of the capsule 10 through the sound holes 13.

Each sound hole 13 has an opening width smaller than a diameter of circular sound holes or an opening width of rectangular sound holes of conventional types. This effectively prevents entry of dust and waterdrops.

Second Embodiment

Figure 3:
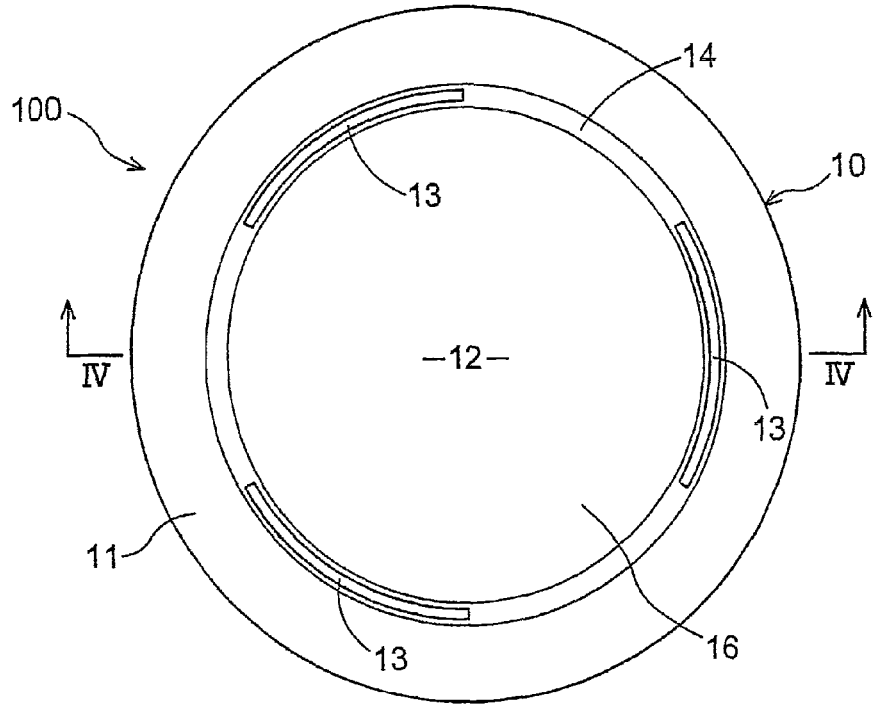
FIG. 3 is a top plan view of the ECM in accordance with the second embodiment of the present invention.
Figure 4:
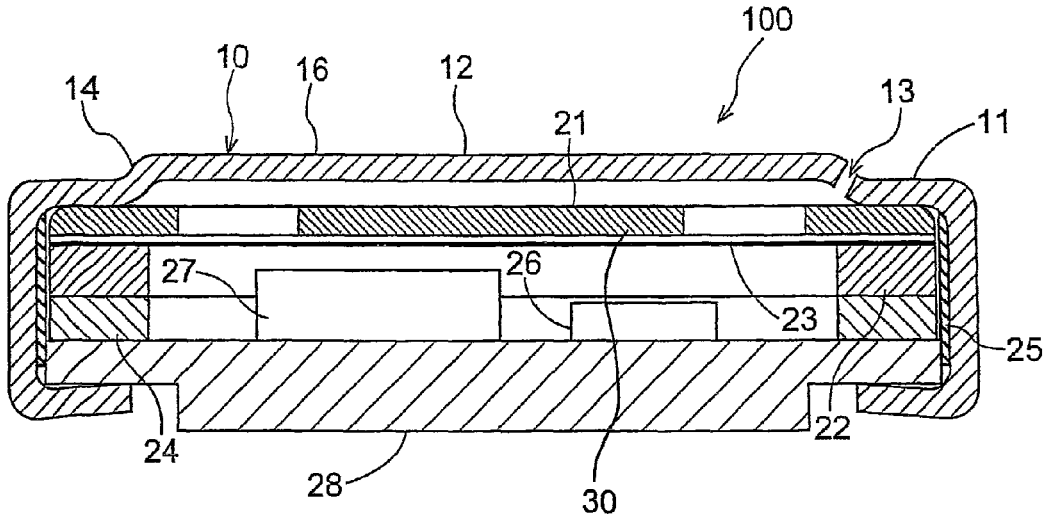
FIG. 4 is a sectional view of the ECM taken along the line IV-IV of FIG. 2.

A second embodiment of the ECM 100 in accordance with the present invention will be described hereinafter with reference to FIGS. 3 and 4. With respect to the same components as those described in the first embodiment, like reference numerals in FIGS. 1 and 2 are affixed to like components, and are not described further. The ECM 100 in accordance with the second embodiment is enclosed by a cylindrical capsule 10. The capsule 10 includes an upper surface having a first top surface 11 and a second top surface 16 projecting from the first top surface 11. The second top surface 16 acts as the suctioned portion 12 on which suction force is applied by the suction nozzle of the suction-type transporting device.

A boundary surface 14 is provided between the first top surface 11 and the second top surface 16 at a predetermined angle with respect to the first top surface 11 and the second top surface 16. The boundary surface 14 has high rigidity against a force exerted on the first top surface 11 and the second top surface 16 in a direction of a predetermined angle. Where the predetermined angle is 90 degrees, for example, the boundary surface 14 advantageously prevents resilient deformation of the capsule 10 caused by the force exerted in the direction normal to the first top surface 11 and the second top surface 16.

It should be noted that dust and waterdrops often come flying toward the ECM 100 from the direction substantially normal to the first top surface 11.

In view of this, the sound holes 13 in accordance with this embodiment are formed in the boundary surface 14 defining an outer edge of the second top surface 16. Since each sound hole 13 opens in a direction different to the flying direction of dust and waterdrops, the arrangement in accordance with the present invention can considerably reduce the chances that dust and waterdrops enter the capsule 10.

In addition, the suction nozzle does not contact the sound holes 13 tight when the suction nozzle applies suction force on the suctioned portion 12, reducing the risk of the back electrode plate 21 and the diaphragm 23 mounted inside the capsule 10 being damaged.

On top of the above, according to the arrangement of this embodiment, since a space is formed between part of the capsule 10 including the second top surface 16 and the back electrode plate 21, the washer ring 20 required in the first embodiment may be dispensed with.

Consequently, it is possible to provide the ECM with the reduced number of parts.

Third Embodiment

Figure 5:
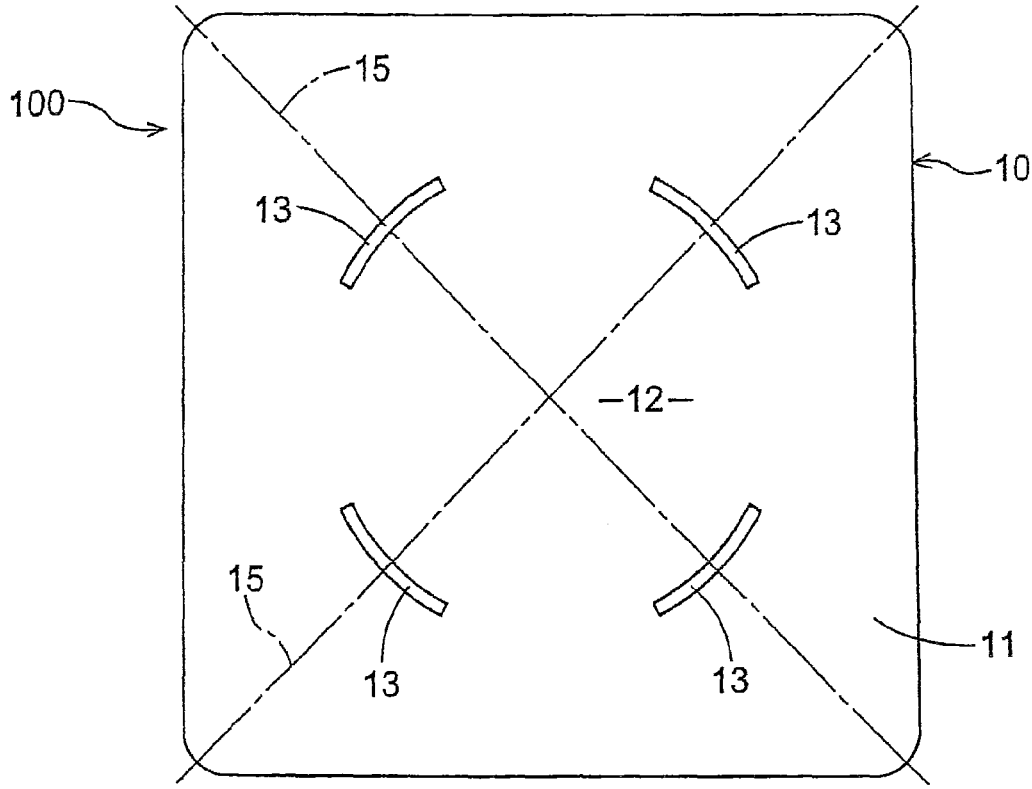
FIG. 5 is a top plan view of an ECM in accordance with the third embodiment of the present invention.
Figure 6:
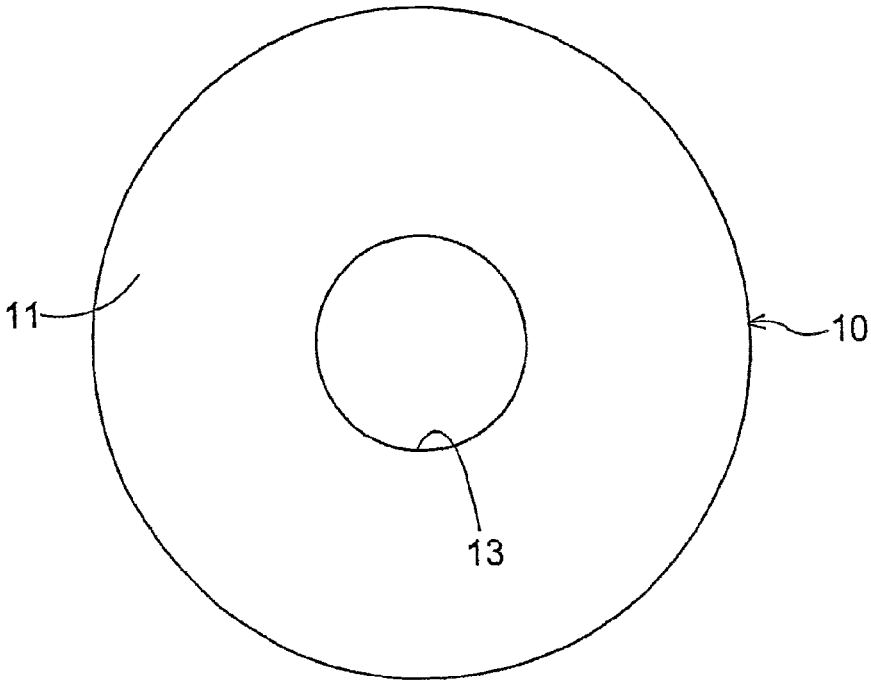
FIG.6 PRIOR ART
FIG. 6 is a top plan view of a conventional ECM.

A third embodiment in accordance with the present invention will be described with reference to FIG. 5. A capsule 10 in accordance with the third embodiment has a bottomed rectangular (or polygonal) tubular shape. Sound holes 13 including arc shaped slits are provided in the top surface 11 so that the center of each sound hole 13 is positioned on a diagonal line 15 of the top surface 11. According to this arrangement, the sound holes 13 are formed at positions most remote from the edges of the top surface 11, which can maintain high rigidity of the capsule 10. More particularly, the rigidity of the capsule 10 is determined by the arrangement of side walls of the capsule 10 relative to the top surface 11. As in this construction, the arc slit-shaped sound holes 13 are arranged remote from the edges of the capsule 10, which increases the area of the top surface 11 formed continuously from the side walls of the capsule 10. This enhances the effects of mutually complementing the rigidity between the side walls and the top surface 11, thus increasing the rigidity of the capsule 10.

Other Embodiments (1) The foregoing embodiments have not referred to the positions of the sound holes 13 in a radial direction of the top surface 11. In this regard, the sound holes 13 may be formed outside a circle having the center that coincides with the center of the top surface 11 and having the radius that is half the shortest radius measured from the center of the top surface 11 to the outer edges thereof. As a result, a large area for the suctioned portion 12 can be secured, and also it is possible to select a nozzle having a size and a shape suitable for transporting the ECM 100 at need.

Further, due to the large suctioned portion 12, it becomes easy to apply suction force on the portion where the center of gravity is located.

It should be noted that the positioning of the sound holes 13 is determined taking the size of the suction nozzle into account in order to apply suction force on the ECM 100 reliably by the transporting device. Thus, the positions of the sound holes 13 are not limited to outside the circle having the radius that is half the shortest radius. In this way, the positions of the sound holes 13 are variable with the outer diameter of the suction nozzle or the size of the ECM 100 as needed.

(2) The sound holes 13 are formed as the arc shaped slits according to the foregoing embodiments. Instead, the sound holes 13 may comprise a series of fine round holes or polygonal holes arranged in arc shape circumstantially around the suctioned portion 12. Such sound holes 13 can perform substantially the same functions as the sound holes 13 comprising the arc shaped slits.

(3) According to the foregoing embodiments, the sound holes 13 are arranged in arc centering on the center of the capsule 10. Instead, these holes may comprise arc, curved, straight or bent slits spreading radially from the center.

(4) The present invention is advantageously applicable mainly to the ECM 100 of the back electret type and of the type with the back electrode plate 21 and the diaphragm 23 whose vertical positions are reversed from those in the back electret type ECM. The present invention is also applicable to the ECM 100 of the front electret type when the material and the thickness of the capsule 10 are varied to enhance the rigidity to prevent the capsule 10 from being deformed in time of suctioning by the transporting device.

What is claimed is:

1. An electret condenser microphone comprising:

a metal capsule having a top surface provided with sound holes for receiving sound;

a diaphragm;

a back electrode plate that faces either one of surfaces of the diaphragm and that is provided separately from the capsule; and an electret layer formed on the back electrode plate or the diaphragm, the diaphragm, the back electrode plate and the electret layer being all mounted inside the capsule, wherein the top surface includes a suctioned portion in its center on which suction force can be applied by a suction-type transporting device, wherein the sound holes are formed circumferentially around the suctioned portion, wherein the top surface includes a first top surface and a second top surface projecting from a central area of the first top surface;

the suctioned portion is formed in the second top surface; and the sound holes are formed in a boundary between the first top surface and the second top surface.

2. The electret condenser microphone claimed in claim 1, wherein the sound holes are formed outside a circle having a center that coincides with the center of the top surface and having a radius that is half the shortest radius measured from the center of the top surface to the outer edges thereof.

3. The electret condenser microphone claimed in claim 1, wherein the sound holes include arc shaped slits arranged circumstantially around the suctioned portion.

4. The electret condenser microphone claimed in claim 3, wherein the sound holes are formed outside a circle having a center that coincides with the center of the top surface and having a radius that is half the shortest radius measured from the center of the top surface to the outer edges thereof.

5. The electret condenser microphone claimed in claim 3, wherein the top surface has a rectangular shape, and wherein each of the sound holes has its center positioned on a diagonal line of the top surface.

* * * * *

UNITED STATES PATENT AND TRADEMARK OFFICE

CERTIFICATE OF CORRECTION

PATENT NO. : 8,135,150 B2
APPLICATION NO. : 11/903189
DATED : March 13, 2012
INVENTOR(S) : Toshiro Izuchi et al.

It is certified that error appears in the above-identified patent and that said Letters Patent is hereby corrected as shown below:

ON THE TITLE PAGE:
Item (54), Column 1, Line 1, delete “CONDENSOR” and insert -- CONDENSER --

IN THE SPECIFICATIONS:
Column 1, Line 1, delete “CONDENSOR” and insert -- CONDENSER --

Signed and Sealed this
Twenty-sixth Day of June, 2012

David J. Kappos

David J. Kappos
*Director of the United States Patent and Trademark Office*